US005562554A

United States Patent [19]

Carson

[11] Patent Number: 5,562,554

[45] Date of Patent: Oct. 8, 1996

[54] CENTRIFUGE ROTOR HAVING A FUSED WEB

[75] Inventor: David M. Carson, Newtown, Conn.

[73] Assignee: E. I. Du Pont de Nemours and Company, Wilmington, Del.

[21] Appl. No.: 958,991

[22] Filed: Oct. 9, 1992

[51] Int. Cl.[6] ..... B04B 7/06

[52] U.S. Cl. ..... 494/12; 494/16

[58] Field of Search ..... 74/572, 573 R, 74/574; 494/12, 16, 19, 20, 31, 81, 85

[56] References Cited

U.S. PATENT DOCUMENTS

| | | | |
|---|---|---|---|
| 3,101,322 | 8/1963 | Stallman et al. | 233/24 |
| 3,366,320 | 1/1968 | Cho | 494/16 |
| 3,662,619 | 5/1972 | Seeliger | 74/572 |
| 3,806,284 | 4/1974 | Jacobs | 417/534 |
| 3,819,111 | 6/1974 | Romanauskas et al. | 233/27 |
| 3,901,434 | 8/1975 | Wright | 233/27 |
| 3,970,245 | 1/1976 | Aeschlimann | 494/12 |
| 3,990,633 | 11/1976 | Stahl et al. | 233/23 R |
| 4,111,067 | 9/1978 | Hodson | 74/572 |
| 4,111,355 | 9/1978 | Ishimaru | 233/20 |
| 4,132,130 | 1/1979 | Schneider | 74/572 |
| 4,202,487 | 5/1980 | Edwards | 233/1 |
| 4,360,151 | 11/1982 | Cowell | 494/16 |
| 4,372,483 | 2/1983 | Wright | 494/16 |
| 4,412,830 | 11/1983 | Strain | 494/16 |
| 4,449,966 | 5/1984 | Piramoon | 494/20 |
| 4,477,226 | 10/1984 | Carreno | 416/144 |
| 4,507,047 | 3/1985 | Coons | 415/9 |
| 4,509,896 | 4/1985 | Linsker | 415/9 |
| 4,547,185 | 10/1985 | Hellenkant | 494/37 |
| 4,553,955 | 11/1985 | Lam et al. | 494/16 |
| 4,568,325 | 2/1986 | Cheng et al. | 494/84 |
| 4,586,918 | 5/1986 | Cole | 494/20 |
| 4,693,702 | 9/1987 | Carson et al. | 494/61 |
| 4,753,630 | 6/1988 | Romanauskas | 494/9 |
| 4,753,631 | 6/1988 | Romanauskas | 494/9 |
| 4,801,290 | 1/1989 | Gunter | 494/16 |
| 4,817,454 | 4/1989 | Schëpf et al. | 74/572 |
| 4,822,330 | 4/1989 | Penhasi | 494/16 |
| 4,824,429 | 4/1989 | Keunen et al. | 494/16 |
| 4,850,951 | 7/1989 | Cheng et al. | 494/16 |
| 4,991,462 | 2/1991 | Breslich | 494/16 |
| 5,024,646 | 6/1991 | Lewis | 494/16 |
| 5,127,895 | 7/1992 | Pawlovich | 494/16 |

FOREIGN PATENT DOCUMENTS

| | | |
|---|---|---|
| 0258652 | 1/1987 | European Pat. Off. . |
| 3806284 | 4/1989 | Germany . |

*Primary Examiner*—David Scherbel
*Assistant Examiner*—Terrence Till

[57] ABSTRACT

A centrifuge rotor has a central hub with a mounting recess therein, a ring disposed concentrically about the hub, the ring having a plurality of cavities formed therein, and a relatively thin web connecting the hub and the ring. The web defines a localized region which exhibits a stress therein that is greater than the stress present in any other portion of the rotor when the rotor is operating at the predetermined operating speed, so that, over operation time, the probability that rotor failure will occur only in the web is enhanced. The cavity ring has an annular rim with an upper surface having a predetermined reference line defined thereon. A portion of the upper surface of the rim defined relative to the reference line is relieved. The radial location of the relieved portion of the upper surface with respect to the reference line is governed in accordance with the axial position of the web with respect to the center of mass of the ring.

15 Claims, 4 Drawing Sheets

CENTRIFUGE ROTOR HAVING A FUSED WEB

BACKGROUND OF THE INVENTION

1. Field of the Invention

The present invention relates to a centrifuge rotor, and in particular, to a centrifuge rotor having a relatively thin web disposed radially between an inner hub and an outer cavity ring, the web defining a predetermined localized region where the occurrence of a rotor failure due to fatigue is most probable.

2. Description of the Prior Art

A centrifuge rotor is a relatively massive member used within a centrifuge instrument to expose a liquid sample to a centrifugal force field. The rotor is provided with a plurality of cavities in which containers carrying the liquid sample are received. The rotor has a central, axial mounting recess provided therein, whereby the rotor may be mounted to a shaft extending from a source of motive energy.

The possibility exists that, in use, the rotor may break apart due either to i) fatigue failure of the rotor material, ii, the imposition of excessive centrifugally induced stresses when the rotor is rotated past its predetermined rated speed (overspeed failure), or iii) failure from the accumulated effects of corrosion caused by sample spillage. A failure produces a number of rotor fragments each of which carries a portion of the kinetic energy of the rotor. A containment system is provided in the centrifuge instrument in order to contain the resultant rotor fragments within the confines of the instrument, thus avoiding damage to people and/or property.

The size of the fragments usually depends upon the cause of the rotor failure. In a rotor failure caused by corrosion, for example, the fragments are relatively small, because the region of the rotor affected by corrosion is the sample receiving cavity near the rotor periphery. Rotor failure caused by fatigue or overspeed may be more severe.

The most severe form of rotor failure is a so-called "bi-hub" failure, in which the rotor breaks into two relatively massive fragments. The origin of the failure in a bi-hub failure is usually in the vicinity of the rotor mounting recess. In such a failure, although the containment system is designed to contain the fragments within the instrument, the impact of the fragments may cause movement of the instrument in the laboratory.

Various forms of mechanical arrangements are known which minimize the possibility of rotor failure due to overspeed. One class of overspeed protection arrangement includes a frangible member which fractures when an overspeed condition is imminent to mechanically disconnect the rotor from its source of motive energy. U.S. Pat. Nos. 3,990,633 (Stahl), 4,568,325 (Cheng et al.), 4,753,630 (Romanauskas), 4,753,631 (Romanauskas), the latter two patents being assigned to the assignee of the present invention) are representative of this class of overspeed protection arrangement. Another overspeed protection arrangement generally of this form includes a frangible member which fractures when an overspeed condition is imminent to electrically disconnect the rotor from its source of motive energy. U.S. Pat. No. 3,101,322 (Stallman) is representative of this form of arrangement.

Another known overspeed protection arrangement also uses a frangible element on the rotor which fractures when rotor speed reaches a predetermined value. The fragment so produced causes the rotor to be braked by increasing windage within the chamber in which the rotor is carried or by mechanical friction with the surrounding structure, thereby slowing rotor speed. Representative of this class of overspeed protection arrangement are U.S. Pat. No. 4,693,702 (Carson et al., assigned to the assignee of the present invention), U.S. Pat. No. 4,132,130 (Schneider), 4,509,896 (Linsker), and 4,507,047 (Coons).

Other arrangements are known which minimize the possibility of rotor failure due to fatigue of the material. One form of such a rotor protection arrangement limits the stress produced in the vicinity of the mounting of the rotor to the shaft. U.S. Pat. No. 4,822,330 (Penhasi) is believed exemplary of this class of device. German Patent 3,806,284 (Hirsch) discloses a centrifuge rotor having portions of the undersurface removed to reduce stress in the rotor.

Another alternative to control of the effects of rotor failure is to design a rotating apparatus, as a flywheel, to exhibit predetermined areas of vulnerability of rupture. The area of vulnerability may be defined by regions of weaker material or by stress risers in the material of the flywheel. Thus, in the event of an overspeed, failure will most likely occur in the area of vulnerability, producing a fragment having a predictable mass. U.S. Pat. Nos. 3,662,619 (Seeliger) and 4,111,067 (Hodson) are believed exemplary of this class of device.

SUMMARY OF THE INVENTION

In a first aspect the present invention relates to a centrifuge rotor having a central hub with a mounting recess therein, a ring disposed concentrically about the hub, the ring having a plurality of cavities formed therein, and a relatively thin web connecting the hub and the ring. The web defines a localized region which exhibits a stress therein that is greater than the stress present in any other portion of the rotor when the rotor is operating at the predetermined operating speed. Thus, over operation time, the probability that rotor failure will occur only in the web is enhanced. Locating the highly stressed localized region of the rotor in the web insures a rotor failure will produce fragments in which the rotational energy component is significantly higher than the translational energy component.

The cavity ring has an annular rim with an upper surface thereon. The upper surface of the rim has a predetermined reference line is defined thereon. In accordance with another aspect of this invention a portion of the upper surface of the rim defined relative to the reference line is relieved. The radial location of the relieved portion of the upper surface relative to the reference line is governed in accordance with the axial position of the web with respect to the center of mass of the ring. If the center of mass of the ring is located axially above the web, the portion of the upper surface of the rim disposed radially inwardly of the reference line is relieved. Conversely, if the center of mass of the ring is located axially below the web, it is the portion of the upper surface of the rim disposed radially outwardly of the reference line is relieved.

The rotor may be provided with a cover having a seal groove therein. The seal groove is defined by a radially inner and a radially outer wall. The radially outer wall of the seal groove is substantially radially aligned with the reference line on the upper surface of the rim while the rotor is operating at a predetermined rated operational speed.

The rim may have a planar central land region thereon which may, if desired, have a seal groove disposed therein.

A radial portion of the surface of the rim is relieved, again in accordance with the relative positions of the web and center of mass of the ring.

BRIEF DESCRIPTION OF THE DRAWINGS

The invention will be more fully understood from the following detailed description thereof, taken in connection with the accompanying drawings, in which.

DETAILED DESCRIPTION OF THE INVENTION

Figure 1:
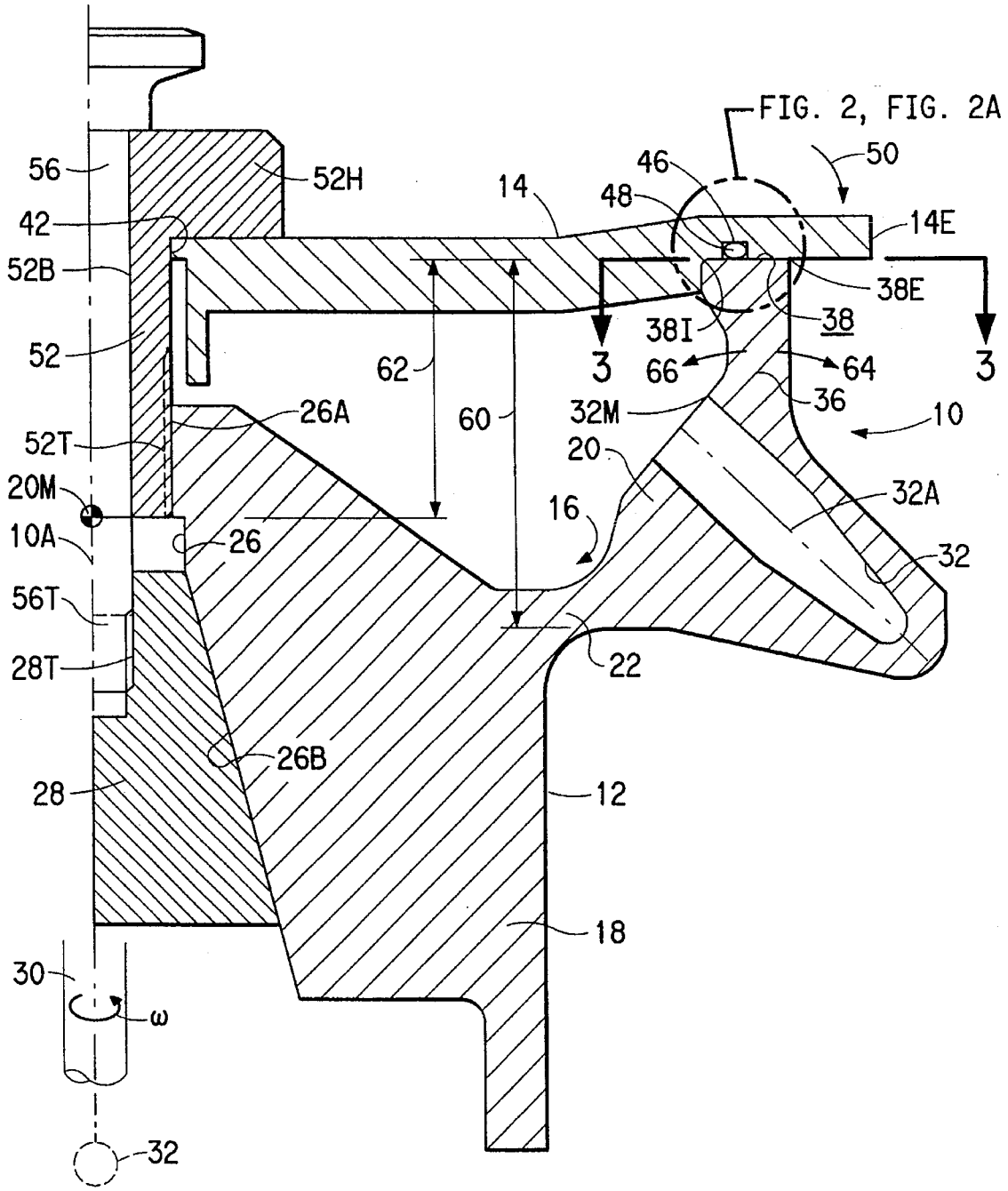
FIGS. 1 and 1A are side elevational views entirely in section of a portion of a centrifuge rotor in accordance with the present.
Figure 1A:
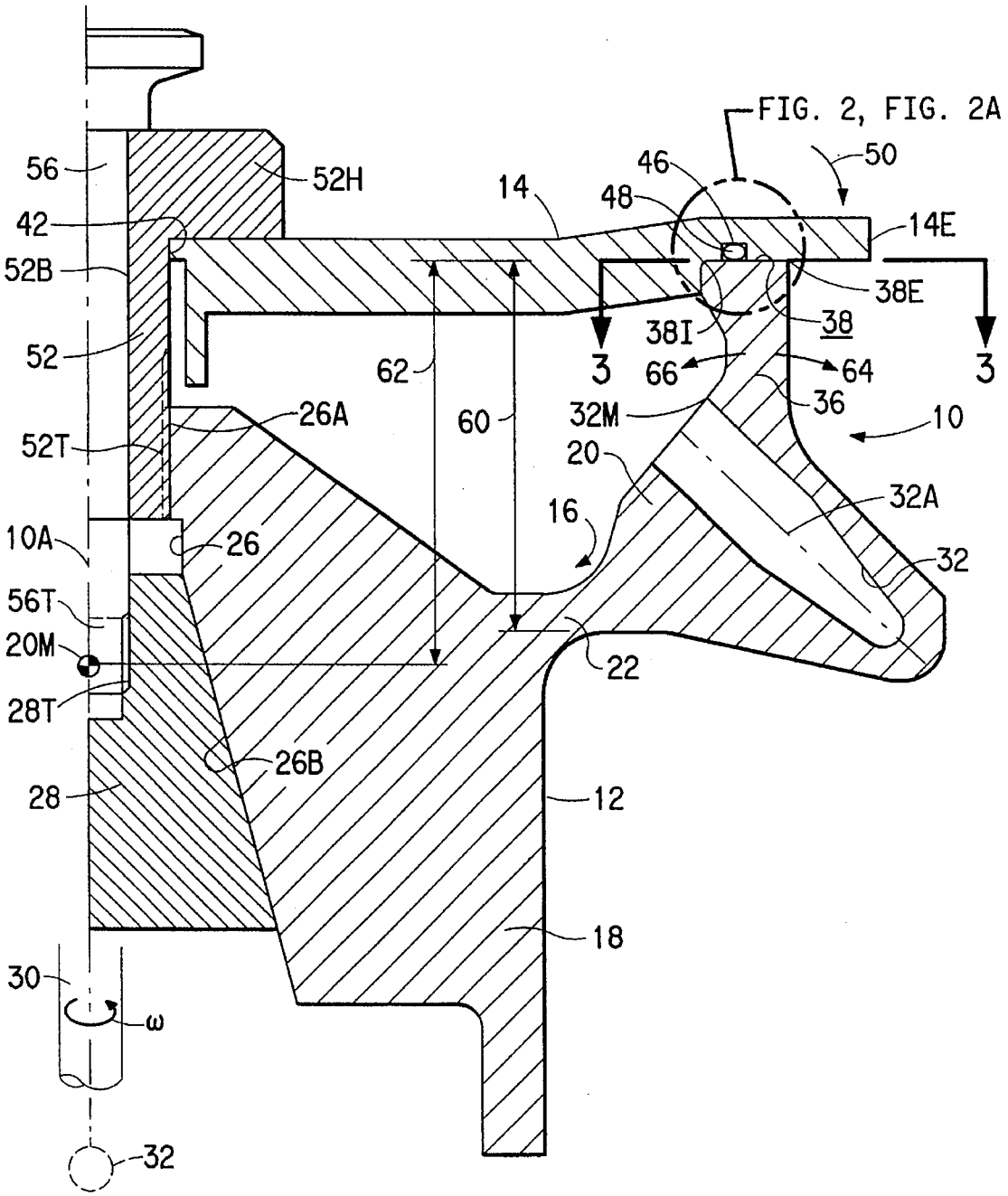

Throughout the following detailed description, similar reference numerals refer to similar elements in all Figures of the drawings.

FIG. 1 illustrates a portion of a centrifuge rotor generally indicated by the reference character 10 in accordance with the present invention. The rotor 10 includes a body 12 and a cooperating cover 14 attachable thereto. As will be developed the rotor body 12 has a relatively highly stressed localized region 16 therein. The localized region 16 is configured such that, in use with the rotor operating at the predetermined operating speed, the region 16 is exposed to a stress that is relatively greater than the stress present in any other portion of the rotor. Thus, over time, the probability of the occurrence of a failure within the highly stressed localized region 16 is greater than the probability of failure in any other region of the rotor 10. Since the failure point of the rotor can be controlled the localized region 16 may be considered to act in the form of a fuse. Moreover, the highly stressed localized region 16 is positioned on the rotor 10 such that each fragment produced as a result of a rotor failure will exhibit a rotational energy component that is high as compared to its translational energy component. The ramifications of this occurrence will be discussed more fully hereafter.

The rotor body 12 comprises a central hub 18, an annular cavity ring 20 disposed concentrically about the hub, and a relatively thin web 22 connecting the hub 18 and the cavity ring 20.

The hub portion 18 of the body 12 has a central opening 26 extending axially therethrough. The upper portion of the opening 26 defines a generally cylindrical threaded bore 26A while the lower portion of the opening 26 defines a generally conical recess 26B.

The recess 26B is sized to receive a frustoconical drive adapter 28 disposed at the upper end of a drive shaft 30. The shaft 30 is itself connected to a motive source indicated diagrammatically by the reference character 32 whereby the rotor 10 may be caused to rotate at a predetermined operating rotational speed co about an axis of rotation 10A that extends centrally through the rotor 10. The drive adapter 28 has a threaded opening 28T disposed at its upper end.

The cavity ring 20 is a generally toroidal shaped member having a center of mass 20M. A plurality of sample container-receiving cavities 32 is formed in the ring 20. The axis 32A of each of the cavities 32 may be inclined at a predetermined angle with respect to the axis of rotation 10A or may extend in parallel thereto. A portion of the ring 20 radially outwardly of the mouth 32M of each cavity 32 defines an upstanding rim 36. The rim 36 has an upper surface 38 thereon. The upper surface of the rim 36 has a radially inner edge 38I and a radially outer edge 38E thereon. The inner edge 38I may be chamfered, as at 38C (FIG. 2), if desired.

The cover 14 is a generally disc-shaped member having a central axial opening 42 therein. An annular seal receiving groove, or gland, 46 is formed in the cover 14. The groove 46 receives an annular elastomeric seal ring 48. The groove 46 is radially situated at a predetermined location on the cover 14 determined with respect to a predetermined reference datum defined on the upper surface 38 of the rim 36. The groove 46 is defined by a radially inner surface 46I, a radially outer surface 46E, and a bottom surface 46B. In normal operation the radially outer edge 14E of the cover 14 is urged toward the rotor 10, in the direction of the arrow 50, to cause the seal ring 48 to maintain contact with the surface 38 of the rim 36 thereby to seal the interior of the rotor 10.

The cover 14 is secured to the rotor body 12 by a generally elongated, axially extending pin 52. The pin 52 has a threaded portion 52T that engages with the threaded portion 26A of the opening 26. The enlarged head 52H of the pin 52 bears against the upper surface of the cover 14. A central bore 52B extends axially through the pin 52.

The rotor 10 is secured to the drive adapter 28 using a threaded rotor hold down bolt 56. The bolt 56 extends through the central axial bore 52B in the pin 52. The threaded end 56T of the bolt 56 engages with the threads 28T in the drive adapter 28.

The web 22 lies between the hub 18 and the cavity ring 20. The web 22 is suitably configured to define the predetermined localized region 16 within which the probability of rotor failure is relatively high. The structural shape exhibited by the relatively fragile web 22 and its location between the more massive hub 18 and cavity ring 20 results, upon the occurrence of rotor failure, in the production of two rotor fragments. One fragment, the hub portion 18, remains mounted to the drive adapter 28. The other fragment, the toroidal cavity ring portion 20, remains generally concentric with the hub. To assure with reasonable confidence that a rotor failure will occur within the web 22 the stress level therein should be at least 1.5 to 2.0 times the stress elsewhere in the rotor 10. Reasonable confidence as to the occurrence of a failure in the localized may, in some instances, be assured with a lesser stress level.

The rotational energy of a rotor before the failure thereof is defined as $$0.5(I.\omega^2) \quad (1)$$

where I is the mass moment of inertia of the rotor 10 about the axis of rotation 10A, and ω is the operating rotational speed of the rotor.

Each fragment produced when a rotating body such as a rotor fails has two energy components: a rotational energy component and a translational energy component.

The rotational energy component of each rotor fragment is given by Equation (1), with I representing in this case the mass moment of inertia of the rotor fragment about its axis of rotation. The rotational energy component of each rotor fragment is mainly dissipated through friction generated as the fragment rotates against the containment walls and does not cause significant deformation of the containment system or movement of the centrifuge instrument.

The translational energy component of each rotor fragment is given by $$0.5M.(R.\omega)^2 \quad (2)$$

where M is the mass of the rotor fragment,

R is the radial distance between the axis of rotation of the rotor before failure and the center of gravity of the fragment after failure, and ω is the operating rotational speed of the rotor.

It is the translational energy component of a rotor fragment that causes deformation of the containment system and movement of the centrifuge instrument.

Owing to the presence and structural form of the web 22 failure of the rotor 10 results in fragments having relatively high rotational energy components as opposed to translational energy components. Since the hub fragment would remain on the drive, all of its energy remains in rotational form. Upon failure the toroidal cavity ring fragment would undergo only a small shift in its center of mass. Thus the term R in the exponential quantity Equation (2) is minimized, consequently minimizing the translational energy component. By producing fragments in which most of the original rotor energy is kept in the form of rotational energy containment energy deformation and instrument movement is minimized.

A rotor 10 in accordance with the present invention as hereinabove described may be fabricated from any suitable rotor material, such as aluminum, titanium or plastic. The rotor may be formed by any suitable manufacturing technique, such as molding, forging, casting, or machining.

Owing to the relative flexibility of the web 22, during normal operation of the rotor the cavity ring 20 has a tendency to flex, or pivotally move, with respect to the hub 18. The direction of the pivotal movement of the ring 20 is dependent upon the relative axial positions of the center of mass 20M of the cavity ring 20 and the web 22.

Using the upper surface 38 of the rim 36 as a convenient reference datum it may be seen from FIG. 1 that the web 22 lies a first predetermined axial distance 60 measured along the axis of rotation 10A from the surface 38. The center of mass 20M of the ring 20 lies a second predetermined axial distance 62, measured along the axis of rotation 10A, from the surface 38. The first distance 60 is greater than the second distance 62. In this situation the ring 20 would exhibit a tendency to pivot in the direction of the arrow 64. If the converse situation were true, viz., if the center of mass 20M of the ring 20 was to lie below the web 22 (i.e., the distance 62 is greater than the distance 60), then the ring 20 would exhibit a tendency to pivot in the direction of the arrow 66.

In either event, however, the pivotal movement of the ring 20 could result in either the radially inner edge 38I or the a radially outer edge 38E of the surface 38 of the rim 36 exerting an axially upward force (in the direction of the arrow 68, FIG. 2) on the undersurface of the cover 14. Unless suitable precautions are taken, this movement of the mass 20M ring 20 could break contact between the seal ring 48 and the surface 38 of the rim 36, causing the sealed integrity of the rotor to be broken.

Figure 2:
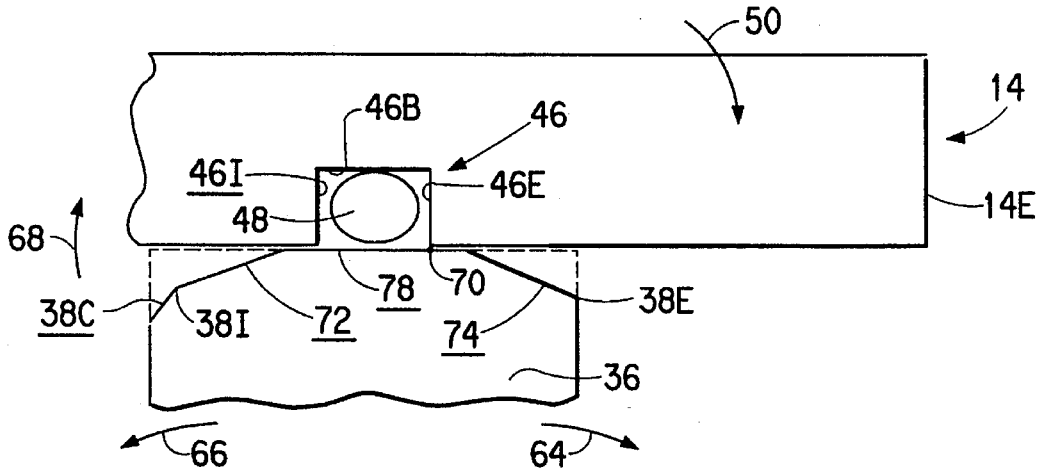
FIGS. 2 and 2A are enlarged side elevational views of the circled portion of the rotor shown in FIGS. 1 and 1A.
Figure 3:
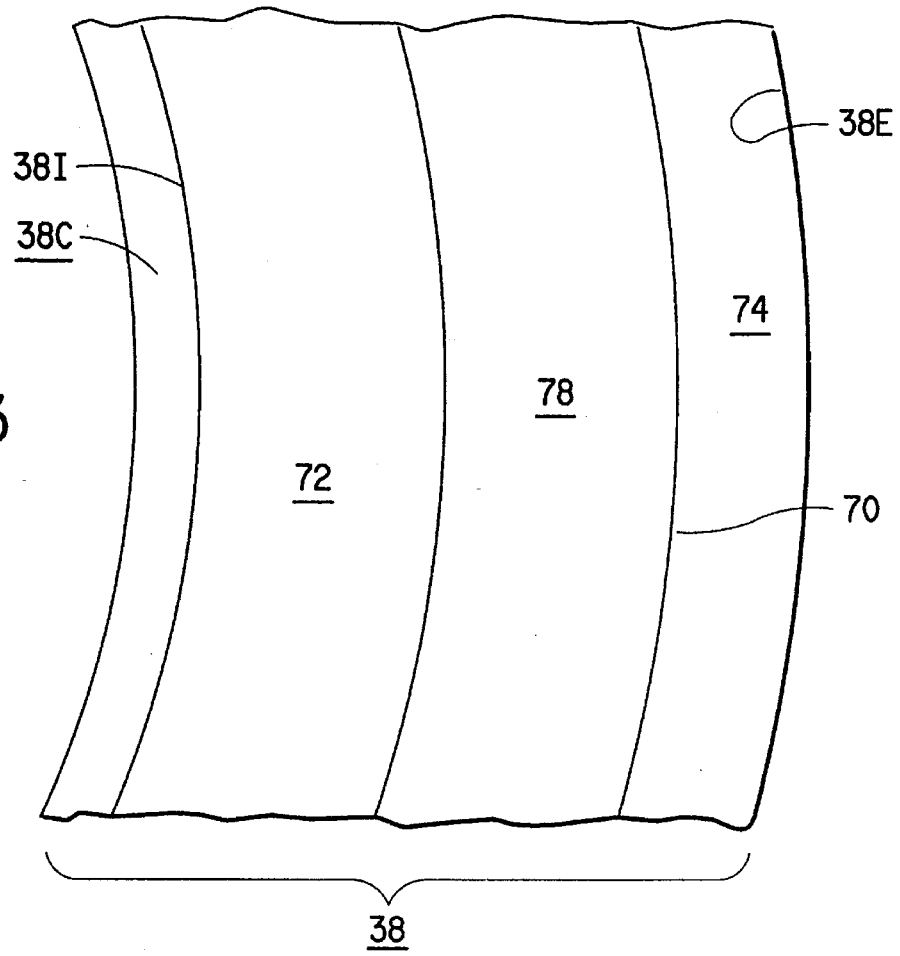
FIG. 3 is a plan view of the rotor taken along view lines 3—3 in FIG. 1.
Figure 2A:
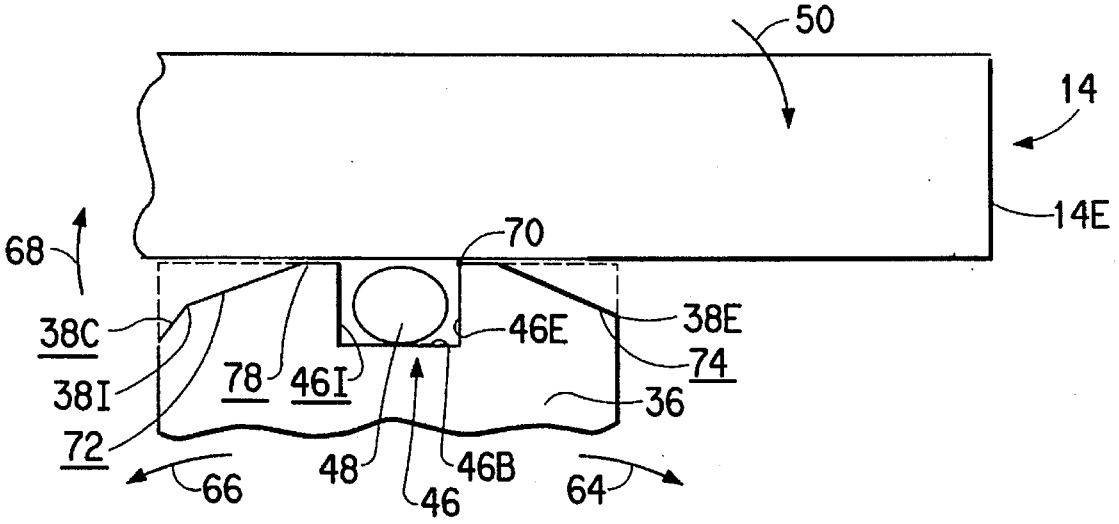

To preclude this occurrence the upper surface 38 of the rim 36 is relieved, or cut away, over some predetermined radial portion thereof. The relieved configuration of the upper surface 38 is best seen in FIG. 2. A predetermined reference line 70 may be defined on the upper surface 38 of the rim 36. As indicated at 72 and 74, respectively, a portion of the surface 38 radially inwardly and/or radially outwardly of the reference line 70 is removed, thereby defining relieved regions thereon. The dashed lines represent the material of the surface 38 if the relieved portions were not provided.

The relative radial position of the relieved portion of the rotor with respect to the reference line 70 is determined by the relative axial position of the center of mass 20M of the ring 20 with respect to the web 22. If the center of mass 20M of the ring 20 is axially above the web 22 (i.e., the distance 60 is greater than the distance 62) the radially inward relieved portion 72 is defined. However, if center of mass 20M of the ring 20 is axially below the web 22 (i.e., the distance 62 is greater than the distance 60) the radially outward relieved portion 74 need only be defined. Of course, if desired, both the portions 72 and 74 may be provided, if desired.

In the preferred instance the surface 38 retains a central land portion 78 thereon. As noted, during normal rotor operation, owing to the flexibility of the web 22, the land portion 78 lies in a plane substantially perpendicular to the axis of rotation 10A. The land portion 78 defines the surface against which the seal ring 48 contacts. The relieved portions 72 and/or 74, as appropriate or desired, lie respectively radially inwardly and/or radially outwardly of the central land region 78. It should be noted that it lies within the contemplation of this invention to utilize the central land region as the site of the seal groove. In such event the seal interface is defined between the seal ring 48 and the undersurface of the cover 14. The relieved portions 72, 74 are, nevertheless, still defined on the upper surface 38 of the rim 36.

The radial extent of the relieved portions 72, 74 is determined by the reference line 70. In the preferred case (with the seal groove 46 in the cover 14) the reference line 70 on the surface 38 is defined by the projection of the radially outer wall surface 46E of the seal groove 46 onto the surface 38 while the rotor is rotating at its predetermined rated rotational speed. The angle of the relieved portions 72, 74 of the surface 38 may be any convenient sufficient to insure that the radially inward edge 38I or the radially outer edge 38E of the surface 38 does not impose a lifting force on the cover 14. Although the relieved portions of the surface are shown as planar, it should be understood that a curved surface may be defined if desired. If the seal groove 46 is formed on the central land region 78 of the surface 38, the relieved portions 72, 74 of the surface 38 are radially inwardly and/or outwardly of the land 78, as the case may be.

Those skilled in the art, having the benefit of the teachings of the present invention as hereinabove set forth may effect numerous modifications thereto. Such modifications lie within the contemplation of the present invention, as defined by the appended claims.

What is claimed is:

1. A centrifuge rotor operable to rotate about an axis of rotation at a predetermined operating speed, the rotor having a central hub, a ring disposed concentrically about the hub, the ring having a plurality of cavities formed therein, the ring having an annular rim with an upper surface thereon, the upper surface having a predetermined reference line thereon, the ring having a center of mass, a relatively thin web connecting the hub and the ring, the web defining a localized region which exhibits a stress therein that is greater than the stress present in any other portion of the rotor when the rotor is operating at the predetermined operating speed so that, over operation time, the probability that rotor failure will occur only in the web is enhanced, the web being spaced a first axial distance from the surface of the rim and the center of mass of the ring being spaced a second axial distance from the surface of the rim, one of the axial distances being greater than the other axial distance, a portion of the upper surface of the rim disposed on at least one predetermined radial side of the reference line being relieved, the portion of the surface that is relieved being determined in accordance with which of the axial distances is the greater, and a cover disposed over the rotor, at least one of the cover or a portion of the upper surface of the rim having an annular seal groove therein, the groove having a radially inner and a radially outer wall, the radially outer wall of the groove being substantially radially aligned with the reference line on the upper surface of the rim while the rotor is operating at a predetermined rated operational speed.

2. The rotor of claim 1 wherein the portion of the upper surface of the rim disposed radially outwardly of the reference is relieved when the first axial distance is less than the second axial distance.

3. The rotor of claim 2 wherein the groove is disposed in the cover, the groove having a seal ring disposed therein.

4. The rotor of claim 1 wherein the portion of the upper surface of the rim disposed radially inwardly of the reference is relieved when the first axial distance is greater than the second axial distance.

5. The rotor of claim 4 wherein the groove is disposed in the cover, the groove having a seal ring disposed therein.

6. The rotor of claim 1 wherein the upper surface has a predetermined annular planar central land region thereon, the predetermined reference line lying on the annular planar central land region.

7. The rotor of claim 6 wherein the groove is disposed in the cover, the groove having a seal ring disposed therein.

8. The rotor of claim 6 wherein the groove is disposed in the planar central land region of the ring, and wherein the groove has a seal ring disposed therein.

9. The rotor of claim 6 wherein the portion of the upper surface of the rim disposed radially outwardly of the planar central land region is relieved when the first axial distance is less than the second axial distance.

10. The rotor of claim 9 wherein the groove is disposed in the planar central land region of the ring, and wherein the groove has a seal ring disposed therein.

11. The rotor of claim 9 wherein the groove is disposed in the cover, the groove having a seal ring disposed therein.

12. The rotor of claim 6 wherein the portion of the upper surface of the rim disposed radially inwardly of the planar central land region is relieved when the first axial distance is greater than the second axial distance.

13. The rotor of claim 12 wherein the groove is disposed in the cover, the groove having a seal ring disposed therein.

14. The rotor of claim 12 wherein the groove is disposed in the planar central land region of the ring, and wherein the groove has a seal ring disposed therein.

15. The rotor of claim 1 wherein the groove is disposed in the cover, the groove having a seal ring disposed therein.

* * * * *